US008616225B2

(12) United States Patent
Druecker et al.

(10) Patent No.: US 8,616,225 B2
(45) Date of Patent: Dec. 31, 2013

(54) DISHWASHER HAVING MEANS FOR CHANGING HEAT DISSIPATION

(75) Inventors: Markus Druecker, Guetersloh (DE); Seyfettin Kara, Spenge (DE); Monika Seifert, Detmold (DE); Stefan Tiekoetter, Bielefeld (DE); Cornelius Wolf, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 996 days.

(21) Appl. No.: 12/672,939

(22) PCT Filed: Jul. 24, 2008

(86) PCT No.: PCT/EP2008/006066

§ 371 (c)(1), (2), (4) Date: Feb. 10, 2010

(87) PCT Pub. No.: WO2009/021603

PCT Pub. Date: Feb. 19, 2009

(65) Prior Publication Data

US 2011/0180116 A1 Jul. 28, 2011

(30) Foreign Application Priority Data

Aug. 13, 2007 (DE) ..... 10 2007 038 266

(51) Int. Cl.
*B08B 3/00* (2006.01)

(52) U.S. Cl.
USPC ..... 134/107; 134/56 D; 134/57 D; 134/58 D; 134/105; 134/115 R

(58) Field of Classification Search
USPC ..... 134/56 D, 57 D, 58 D, 105, 107, 115 R
See application file for complete search history.

(56) References Cited

U.S. PATENT DOCUMENTS

| | | | | |
|---|---|---|---|---|
| 3,167,159 | A | 1/1965 | Bovenkerk | |
| 4,871,012 | A * | 10/1989 | Kuo | 165/41 |
| 6,338,350 | B1 * | 1/2002 | Ewen | 134/56 R |
| 2007/0119481 | A1 * | 5/2007 | Jerg | 134/25.2 |

FOREIGN PATENT DOCUMENTS

| | | | | |
|---|---|---|---|---|
| DE | 196 22 882 | A1 | 12/1997 | |
| DE | 19758061 | A1 * | 7/1999 | A47L 15/42 |
| DE | 10346964 | A1 | 5/2005 | |
| EP | 1825800 | A2 | 8/2007 | |
| WO | 2005/034715 | A1 | 4/2005 | |

OTHER PUBLICATIONS

Relationship Between Emissivity and Thermal Conductivity Atallah Dec. 1965.*

Destablized Magnesium Nickel Hydride Noreus et al. Nov. 2001.*

International Search Report mailed Oct. 31, 2008, which issued during the prosecution of corresponding International Patent Application No. PCT/EP2008/006066; 6 pages.

* cited by examiner

*Primary Examiner* — Michael Barr
*Assistant Examiner* — Charles W Kling
(74) *Attorney, Agent, or Firm* — Leydig, Voit & Mayer, Ltd.

(57) ABSTRACT

A dishwasher includes a washing chamber surrounded by walls. The walls include a water-impermeable inner wall and an insulation layer. At least a first wall of the walls has in a first region on an outside thereof an emission changing device configured to change an emission of thermal radiation. The emission changing device includes a layer having a variable emissivity.

6 Claims, 3 Drawing Sheets

DISHWASHER HAVING MEANS FOR CHANGING HEAT DISSIPATION

CROSS REFERENCE TO PRIOR APPLICATIONS

This application is a U.S. National Phase application under 35 U.S.C. §371 of International Application No. PCT/EP2008/006066, filed on Jul. 24, 2008 and claims benefit to German Patent Application No. DE 10 2007 038 266.0, filed on Aug. 13, 2007. The International Application was published in German on Feb. 19, 2009 as WO 2009/021603 under PCT Article 21(2).

FIELD

The present invention relates to a dishwasher having a washing chamber surrounded by walls including a water-impermeable inner wall and an insulation layer.

BACKGROUND

German Patent Application DE 103 46 964 A1 describes a dishwasher whose walls are provided with an insulation having a variable thermal conductivity. This makes it possible to adjust the thermal insulation layer during the dishwashing operation in such a way that it has a low thermal conductivity and the thermal energy is retained in the washing chamber. On the other hand, during the drying process, the thermal conductivity can be increased so that an inner wall is cooled by removal of thermal energy to then accelerate the removal of moisture by condensation. In order to change the thermal conductivity, hydrogen in a metal hydride lattice is released, the hydrogen then changing the thermal conductivity. The use of such a metal hydride lattice in a thermal insulation layer involves a relatively high degree of complexity, because electrical heating means must be provided for the operation of the thermal insulation layer.

Other commercial dishwashers have a washing chamber surrounded by walls which are thermally insulated by an insulation layer. It is possible, for example, to provide an insulation layer of bitumen. However, the thermal conductivity of such insulation layers cannot be changed. Therefore, the thermal conductivity remains constant, irrespectively of whether the heat should be retained in the washing chamber during the dishwashing operation, or whether, during the drying operation, the heat should be removed from the washing chamber as efficiently as possible so as to cool an inner wall and accelerate the condensation process.

SUMMARY

In an embodiment, the present invention provides a dishwasher including a washing chamber surrounded by walls. The walls include a water-impermeable inner wall and an insulation layer. At least a first wall of the walls has disposed in a first region on an outside thereof an emission changing device configured to change an emission of thermal radiation. The emission changing device includes a layer having a variable emissivity.

DETAILED DESCRIPTION

Figure 1:
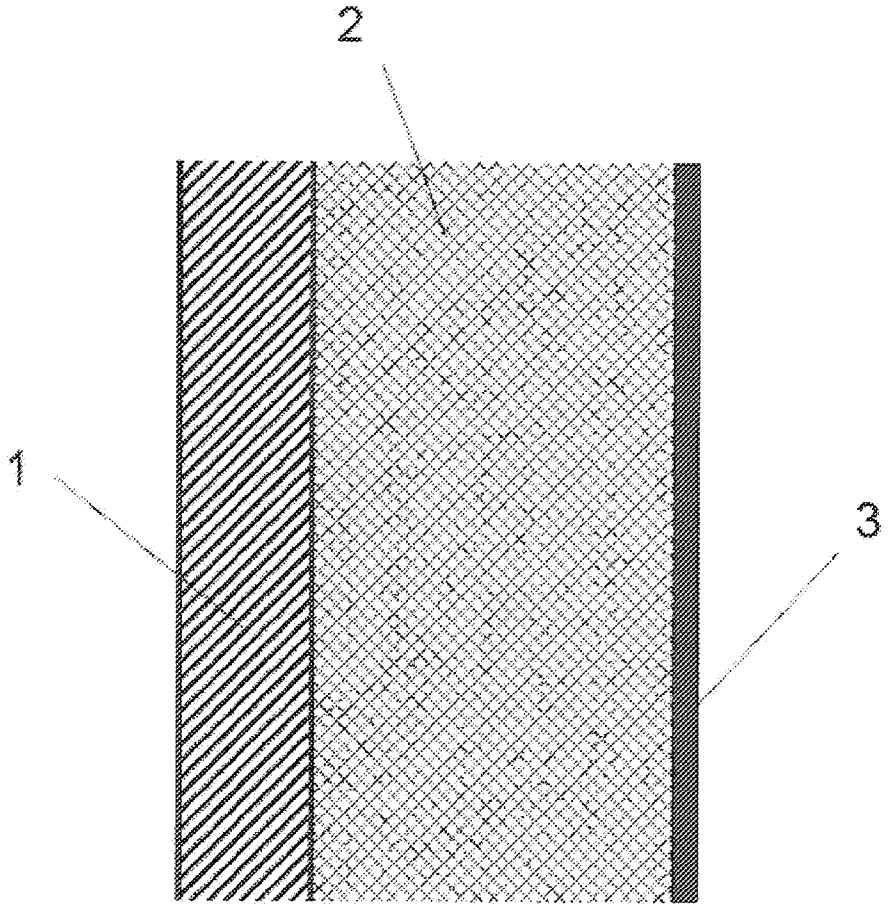
FIG. 1 shows a wall of a dishwasher in accordance with an embodiment of the present invention.

An embodiment of the present invention provides a dishwasher which is simple of design yet allows for changing the emission of thermal radiation of at least one wall.

In accordance with the present invention, the walls surrounded by an insulation layer are provided on the outside, at least in some regions, with means for changing the emission of thermal radiation. This allows the heat contained in a washing chamber during the dishwashing operation to be retained to the extent possible, while during the drying operation, heat can be removed, at least partly, by an increased level of heat emission. There is no need to change the thermal conductivity of the insulation layer for this purpose. Rather, use is made of differences in the thermal radiation in order to operate the dishwasher as effectively and energy-efficiently as possible. This involves minimizing energy losses during the wash cycle, while increasing the level of heat emission during the drying process.

Therefore, advantageously, means for changing the emission of thermal radiation are provided which allow for a high level of heat emission in a first position and a low level of heat emission in a second position. To this end, a layer which may be selected to be dark in color or reflective may be provided on the outside, at least in some regions. It is known that dark matte surfaces are capable of emitting high levels of heat, while light shiny surfaces emit less heat by radiation. Bitumen, for example, has an emission coefficient of nearly 1, while a shiny surface, such as bitumen coated with aluminum foil, has an emission coefficient of about 0.16. In this connection, tests have shown that a dishwasher provided with coated bitumen uses about 40 Wh less energy for a complete wash cycle (standard wash cycle) than one provided with uncoated bitumen. Thus, the differences in the thermal radiation resulting from a different surface design can also be used for optimizing the process sequence performed in a dishwasher.

In another embodiment of the present invention, tiltable slats are provided on the outside, at least in some regions. These slats may have a reflective surface and be movable from a closed position to an open position so as to produce a change in the emission of thermal radiation. Such a slat curtain may be disposed on a side wall of a dishwasher to be able to change the thermal emission via the respective wall surface. Tilting of the slats may preferably occur during switchover from the cleaning process to the drying process.

In a further embodiment of the present invention, the means for changing the emission of thermal radiation have a layer whose emissivity is variable. In this connection, the layer may be changeable in color, for example, depending on the temperature. It is also possible for the emissivity of the layer to be changed by pulses from a controller. In this connection, the layer can be adjusted in such a way that the emissivity is high at high temperatures, while at slightly lower temperatures, thermal radiation is emitted at a lower rate. This is because, especially shortly before the drying cycle, a particularly high temperature is introduced into the washing chamber, so that then a high level of heat emission is required for the subsequent drying operation.

FIG. 1 shows a wall of a washing chamber including a water-impermeable inner wall 1 and an insulation layer 2. The wall has, disposed in a first region on an outside thereof, an emission changing device 3 configured to change an emission of thermal radiation. the emission changing device includes a layer having a variable emissivity.

The present invention will now be explained in greater detail with reference to two exemplary embodiments:

According to a first exemplary embodiment, a dishwasher includes a washing chamber surrounded by walls, the walls including a water-impermeable inner wall and an outer insulation layer of bitumen. At least one wall of the washing chamber has provided thereon a slat curtain having a plurality of tiltable slats, said slats being provided with a reflective surface on one side thereof. During the washing operation, heat emission should be kept to a low level and, therefore, the slats are oriented with their reflective surfaces facing the insulation layer of bitumen. Because of this, the thermal radiation emitted by the dark bitumen is reflected by a suitable color given to the slats or by a coating of aluminum foil. The slats are tilted to facilitate the drying operation, so that the emitted thermal radiation can then pass through between the slats. Behind the slat curtain, there are disposed further units, such as water bags, drying units, or other components, and, therefore, thermal radiation that may be emitted is not immediately reflected by an outer wall. Thus, when the slats are in the closed position, the insulation layer faces a light reflective surface, while in the open position, the slats allow for emission of thermal radiation to facilitate the drying operation.

Figure 2:
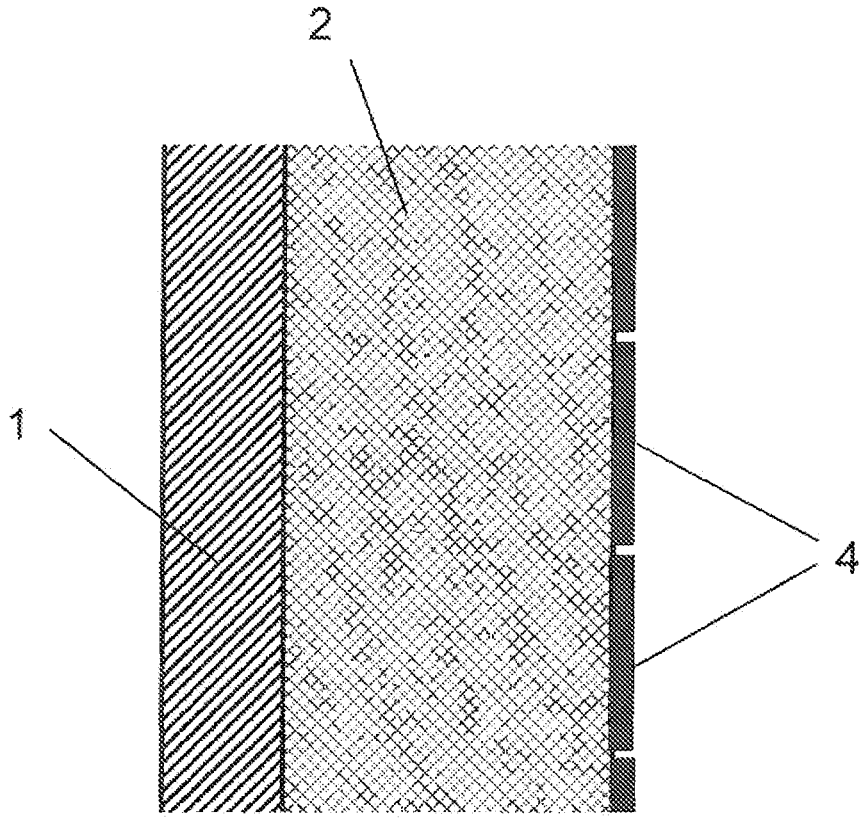
FIG. 2 shows a wall of a dishwasher including tiltable slats in a closed position.
Figure 3:
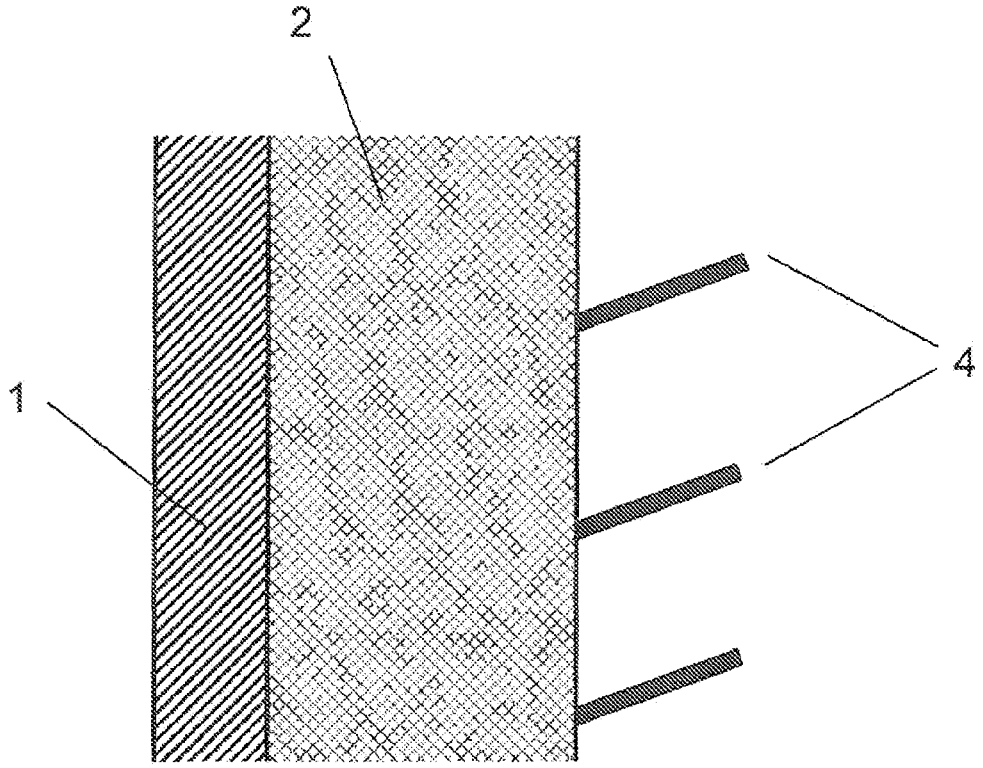
FIG. 3 shows the wall of FIG. 2 with the tiltable slats in an open position.

According to a first exemplary embodiment, shown in FIGS. 2 and 3, a dishwasher includes a washing chamber surrounded by walls, the walls including a water-impermeable inner wall and an outer insulation layer 2 of bitumen. At least one wall of the washing chamber has provided thereon a slat curtain having a plurality of tiltable slats 4, said slats being provided with a reflective surface on one side thereof. During the washing operation, heat emission should be kept to a low level and, therefore, the slats 4 are oriented with their reflective surfaces facing the insulation layer of bitumen (see FIG. 2). Because of this, the thermal radiation emitted by the dark bitumen is reflected by a suitable color given to the slats or by a coating of aluminum foil. The slats 2 are tilted to facilitate the drying operation, so that the emitted thermal radiation can then pass through between the slats 3). Behind the slat curtain, there are disposed further units, such as water bags, drying units, or other components, and, therefore, thermal radiation that may be emitted is not immediately reflected by an outer wall. Thus, when the slats are in the closed position, the insulation layer faces a light reflective surface, while in the open position, the slats allow for emission of thermal radiation to facilitate the drying operation.

Such a coating is preferably composed of polymer microcapsules (about 6 μm in diameter), which are filled with chromophoric components and a medium, it being possible for the medium to be in solid or liquid state. Below the temperature at which the medium changes from the liquid to the solid state, the chromophoric components are in direct contact and the particular color appears. Above the temperature at which the medium changes from the liquid to the solid state, the chromophoric components are no longer in direct contact and the particular color is not visible. This process is reversible, a hysteresis being present between the change from cold to warm and back from warm to cold, so that the temperature at which no color is visible is slightly higher than that at which the color appears again.

The color transition temperature is preferably in a range between 50° C. (122° F.) and 90° C. (194° F.), in particular between 60° C. (140° F.) and 70° C. (158° F.).

Of course, it is also possible to combine the two above-described embodiments, so that both a slat curtain is provided and a coating having a variable emissivity is attached to the insulation layer, at least in some regions.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

What is claimed is:

1. A dishwasher comprising:

a washing chamber surrounded by walls, the walls including a water-impermeable inner wall and an insulation layer, at least a first wall of the walls having disposed in a first region on an outside thereof an emission changing device configured to change an emission of thermal radiation, the emission changing device including a layer having a variable emissivity, wherein the layer is changeable in color as a function of the temperature thereof in a range between 50° C. and 90° C.

2. The dishwasher as recited in claim 1, wherein the emissivity of the layer is configured to be changed by pulses from a controller.

3. The dishwasher as recited in one of claim 1, wherein the layer of variable emissivity includes tiltable slats disposed on the region of the outside of the first wall.

4. The dishwasher as recited in claim 3, wherein the slats have a reflective surface and are movable from a closed position to an open position so as to produce a change in the emission of thermal radiation.

5. A dishwasher comprising:

a washing chamber surrounded by walls, the walls including a water-impermeable inner wall and an insulation layer, at least a first wall of the walls having disposed in a first region on an outside thereof an emission changing device configured to change an emission of thermal radiation, the emission changing device including a layer having a variable emissivity, wherein the layer of variable emissivity includes tiltable slats disposed on the region of the outside of the first wall, the tiltable slats having a closed position facing the insulation layer and an open position.

6. The dishwasher as recited in claim 5, wherein the slats have a reflective surface and are movable from a closed position to an open position so as to produce a change in the emission of thermal radiation.

* * * * *